US005564833A

United States Patent [19]

Proffitt

[11] Patent Number: 5,564,833

[45] Date of Patent: Oct. 15, 1996

[54] CONTAINER BAG

[75] Inventor: Robert Proffitt, Staffordshire, England

[73] Assignee: Mulox IBC Limited, London, England

[21] Appl. No.: 374,801

[22] Filed: Jan. 18, 1995

[30] Foreign Application Priority Data

Jan. 20, 1994 [GB] United Kingdom ..... 9401078

[51] Int. Cl.[6] ..... B65D 30/10

[52] U.S. Cl. ..... 383/22; 383/105; 383/107; 383/109

[58] Field of Search ..... 383/105, 107, 383/108, 109, 113, 17, 22, 24

[56] References Cited

U.S. PATENT DOCUMENTS

| | | | |
|---|---|---|---|
| 4,597,102 | 6/1986 | Nattrass | 383/105 |
| 4,691,371 | 9/1987 | Derby . | |
| 4,703,517 | 10/1987 | Marino . | |
| 4,946,291 | 8/1990 | Schnaars | 383/113 |
| 5,076,710 | 12/1991 | Derby | 383/107 X |
| 5,203,633 | 4/1993 | Derby | 383/107 X |
| 5,222,812 | 6/1993 | Cuddy et al. | 383/107 X |
| 5,328,267 | 7/1994 | Cuddy et al. | 383/105 X |
| 5,468,528 | 11/1995 | Schnaars et al. | 383/107 X |

FOREIGN PATENT DOCUMENTS

| | | |
|---|---|---|
| 0635439 | 5/1994 | European Pat. Off. . |
| 1591091 | 1/1978 | United Kingdom . |
| 2063816 | 12/1980 | United Kingdom . |

*Primary Examiner*—Jes F. Pascua
*Attorney, Agent, or Firm*—Kohn & Associates

[57] ABSTRACT

A container bag i.e. a flexible intermediate bulk container or FIBC (10) comprising a body of flexible material having lifting loops (18) across the corners thereof and baffles (22) to maintain a square configuration is characterized in that a liner (28) is provided sealed to the baffles (22). In accordance with the present invention baffles (22) are positioned within the liner (28) and are sealed to it before the liner (28) is affixed to the FIBC. In this manner, an FIBC can be produced which has both baffles giving it a square configuration and a liner to prevent ingress of moisture and air. The liner taking on the "square" configuration imparts it to the FIBC as a whole. The baffles may protrude from the liner and be attached to the FIBC walls, or they may be wholly within the liner. In either case, the liner (28) will preferably be impervious to air and moisture and may be formed from a polyolefin sheet material.

21 Claims, 5 Drawing Sheets

CONTAINER BAG

TECHNICAL FIELD

This invention relates to container bags and in particular relates to container bags for carrying loads in the range of one-half to two tons and known as flexible intermediate bulk containers (FIBC's).

BACKGROUND OF THE DISCLOSURE

Flexible intermediate bulk containers are increasingly employed in cargo handling and transporting situations, especially for the carriage of particulate or pulverulent material. A typical FIBC will be manufactured from a fabric woven from a polyolefin tape and will have lifting loops. Examples of such containers are described in UK patent numbers 1591091 and 2063816. FIBC's have to meet various national and international safety standards; for example, it is normal to require a 5 to 1 safety ratio. That is, an FIBC rated at one ton should not break under loads of less than 5 tons.

One favored design of FIBC involves the lifting loops being positioned across each of the four corners of the bag. When filled and suspended form the lifting loops, such bags, while generally cubic in configuration, may nevertheless bulge and take on a mere round appearance. This is disadvantageous in that it reduces stacking density. In order to reduce or prevent this, it has been proposed to sew baffles across the corners of the FIBC to produce the so-called "square" bag. The baffles are provided with holes which permit the product to flow from the center of the FIBC to the corners thereby allowing the whole volume to be filled. Such "square" configurations are preferred for each of stacking and density of storage of filled FIBC's.

The FIBC's are normally made from uncoated or extrusion coated material. Uncoated material of course does permit both air and moisture to enter. Even when the FIBC is made from extrusion coated material, the sewing holes produced by the manufacturing process still allow some entry of air and moisture. While this is acceptable for most products, it is not suitable for highly hygroscopic materials or materials requiring particularly high protection from outside contamination such as foodstuffs and pharmaceuticals.

What is needed is to provide an FIBC of square configuration improved in the above respects that can be used with highly hygroscopic material.

SUMMARY OF THE INVENTION

According to the present invention there is provided a container bag which comprises a body of flexible material having lifting loops across the corners thereof and baffles to maintain a square configuration characterized in that a liner is provided sealed to the baffles.

The use of baffles in square configuration FIBC's has hitherto prevented the use of a liner since the baffles would prevent the liner fitting properly in each of the corners of the bag. In accordance with the aspect of the present invention the baffles are passed through the liner and sealed thereto before being affixed to the FIBC. In this manner, an FIBC can be produced which has both baffles giving it a square configuration and a liner to prevent ingress of moisture and air. Since the liner is sealed to the baffles, and the baffles are in turn attached to the FIBC, for example by sewing, gluing or welding, the liner is therefore attached to the FIBC.

However, it may be preferable to attach it further for example at the top edge thereof to eliminate any danger that the top will slip down or fold over before or during filling. In an alternate construction, the baffles need only be affixed to the liner and the liner attached to the FIBC, e.g. at the top thereof. The liner taking on the "square" configuration imparts it to the FIBC as a whole, either case, the liner will preferably be impervious to air and moisture and may be a polyolefin sheet material.

The fabric from which the FIBC of the invention is formed may be a conventional fabric for use in this type of container bag and may be woven from polyethylene or polypropylene tape yarns. Preferably, however at least side walls of the container bag are bade form a fabric having reinforced zones or areas of interwoven reinforcing yarns, for example as disclosed in our UK patent number 1591090. Where such reinforcing areas are provided they may be as described in theft patent and may be formed of interwoven threads of high tensile strength reinforcing yarns such as polyamide, polyester or twisted or fibrillated polypropylene. The lifting loops are attached to such reinforced areas. Alternatively, the FIBC may be "underslung" where the lifting loops extend down the side walls and under the base of the container body. In either case the lifting loops will preferably be of a woven webbing of synthetic yarns, for instance of the type used for car seat belts, for example polyester or polyamide yarns, or may be ropes or hawsers of suitable strength.

The bag of the invention is intended for use with four lifting loops spaced across the corners of the container bag. The corners will normally be defined by side seams and this construction is particularly preferred since it aids the "square" or cubic configuration of the bag when filled and therefore aids stacking of filled FIBC's.

The container bag of the invention may be fitted with a top and/or filling spout as well as a discharge spout as is conventional in the FIBC art.

The baffles may be the same as those used previously in the production of a "square" FIBC such as the "MULOX QUADRO" and may comprise lengths of extruded fabric having diamond shape cut-outs to facilitate particulate material passing therethrough. The baffles will not, in general, extend entirely from the top to the bottom of the respective corners of the FIBC but will be somewhat lesser in length than the height of the FIBC, typically around 16 cm less than the bag height. The baffles will conveniently be sewn, glued or welded to the inside of the FIBC walls at their edges as it known per se. The baffles, in accordance with the invention, may be exposed through appropriate slits in the liner so that only their edges protrude from the exterior thereof, after which the liner and baffles are sealed together by the use of, for example, heat or ultra-sonic sealing so that the slits or sealed to the baffles and an air-tight and water-tight join is produced. Alternatively, the baffles may be sealed to the liner without needing slits.

BRIEF DESCRIPTION OF THE DRAWINGS

The invention will be described further, by way of example, with reference to the accompanying drawings, in which.

DETAILED DESCRIPTION OF THE PREFERRED EMBODIMENTS

Figure 1:
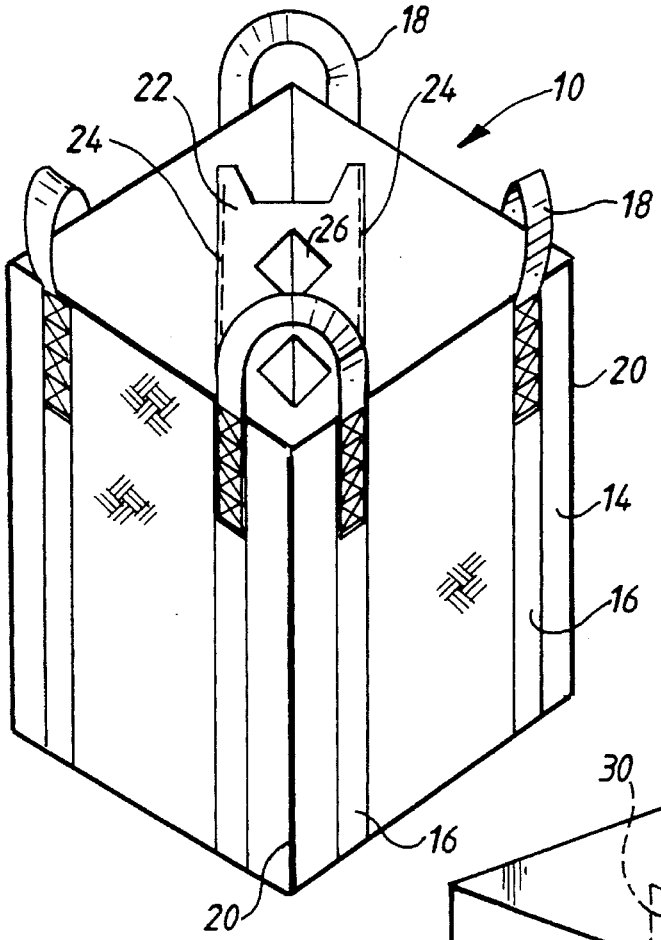
FIG. 1 is a diagrammatic perspective view of an existing "square" FIBC.

Referring to the drawings, FIG. 1 illustrates a conventional "square" bag known as the "MULOX QUADRO". The bag, generally designated 10, comprises side walls 14 each having reinforced zones or areas 16 to which lifting loops 18 are attached. This construction is generally in accordance with our UK patent number 1591090. The walls 14 are joined together at each corner by side seams 20 and the lifting loops 18 straddle each corner. To improve the configuration baffles 22 are sewn across each corner (only one is illustrated in FIG. 1 for clarity) by lines of stitching 24. The baffles comprise lengths of extruded fabric having diamond shape cut outs 26 therein to allow the bag contents to pass therethrough and fill the bag in its entirety.

Figure 2:
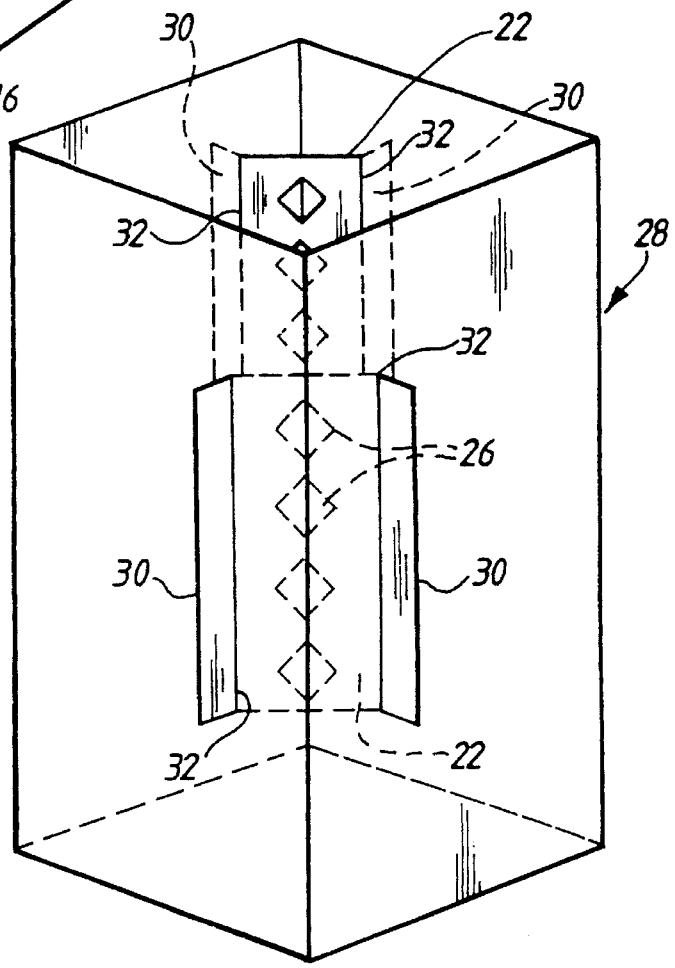
FIG. 2 is a similar view of a liner suitable for use with the present invention.
Figure 3:
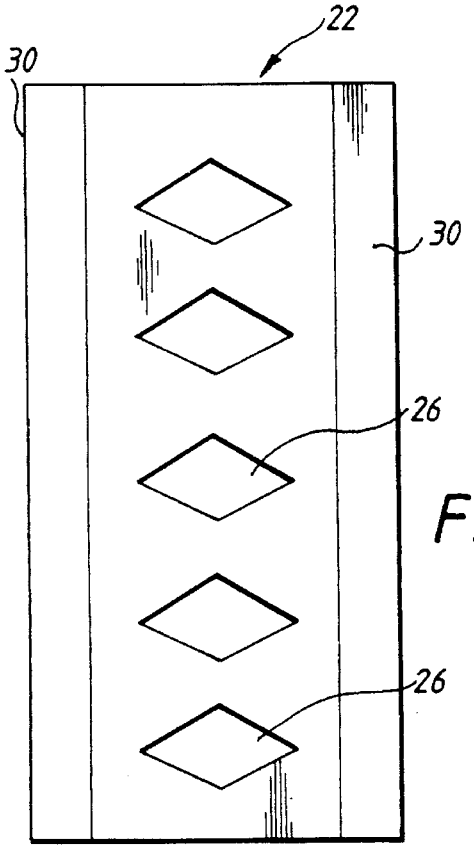
FIG. 3 is an elevational view of a baffle on an enlarged scale.
Figure 4:
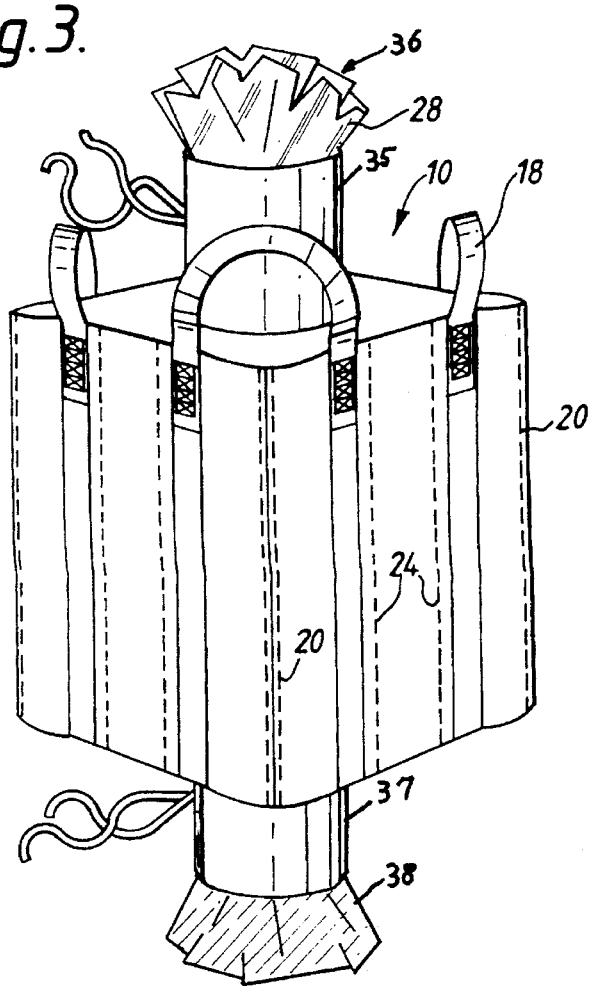
FIG. 4 is a similar view to FIG. 1 of a finished bag in accordance with the invention.

Referring now to FIGS. 2–4, in accordance with one aspect of the present invention, a liner 28 of polyolefin sheet material being impervious to air and moisture is provided of suitable dimensions to fit into the bag 10. Using like numerals for like parts, baffles 22 are provided across each corner (two only are illustrated for clarity). Opposed edges 30 of each baffle 22 are passed through slits 32 formed in the material of the liner 28. Once the edges 30 have been passed through the slits 32 the latter are sealed, e.g. by heat sealing, to the material of the baffle to produce an air and water-resistant join. Thus, when this process has been finished, the bulk of each baffle 22 will be within the liner 28 and across each corners as illustrated in FIG. 2, while the edges 30 protrude from the exterior of the liner.

The edges 30 are then sewn to the inside the walls 14 of the exterior FIBC body 10 by the lines of stitching 24 to complete the production of the product in accordance with the invention. In an alternative construction, not illustrated, the baffles need not extend beyond the liner 28 but may be substantially wholly within it. They are not directly attached to the FIBC but their presence within the liner achieves the object of the invention. The liner 15 preferably attached to the FIBC at the top thereof.

As illustrated in FIG. 4 the bag may be provided with a top filling spout 35 and a discharge spout 37 as is conventional in the FIBC art. When the bag of the invention is filled the particulate or pulverulent material fills the liner passing through the cut-outs 26 in the baffles 22 so as to complete the filling of the bag. The liner, being sealed to the baffles, ensures that the contents are protected from air and moisture. The baffles, as with the "MULOX QUADRO" bag enable the bag to maintain a "square" configuration when filled, for each of stacking and handling.

Figure 5:
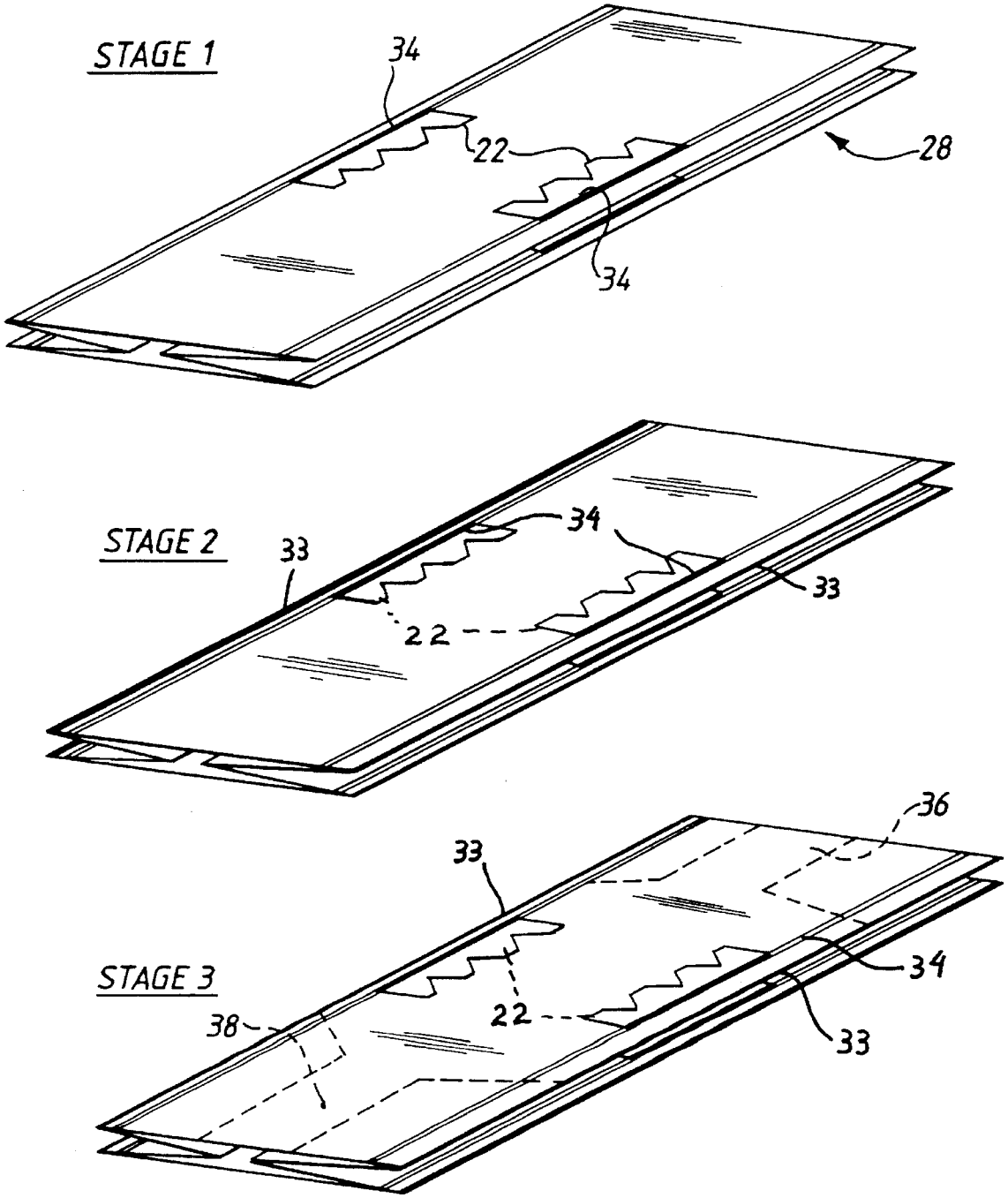
FIG. 5 is a schematic illustrating one method of making a liner with baffles.
Figure 7:
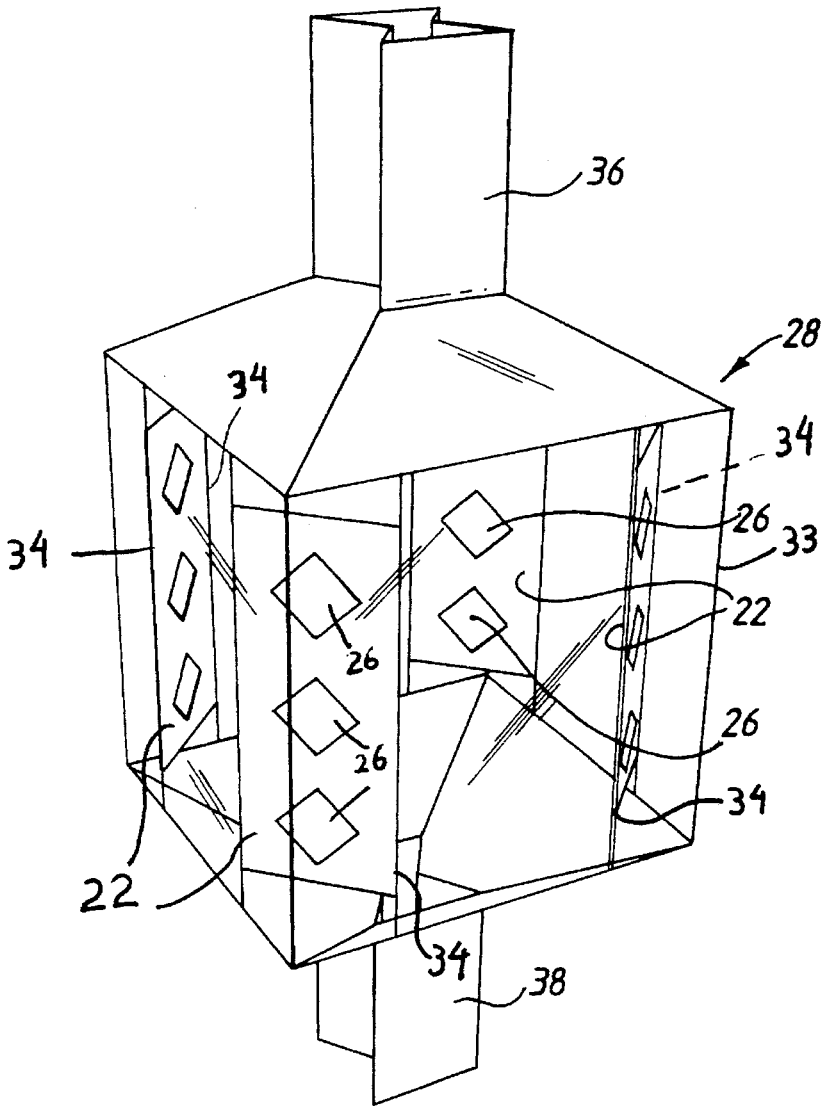
FIG. 7 is a perspective view of a finished liner.
Figure 8:
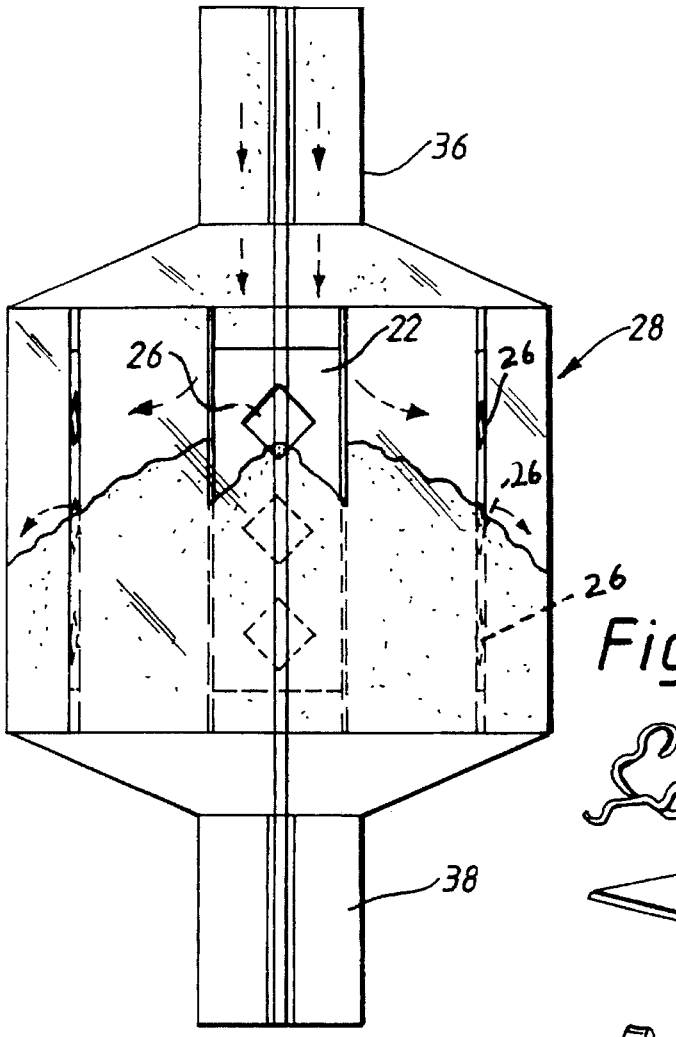
FIG. 8 illustrates the liner of FIG. 7 being filled.

In an alternative construction, the baffles need not extend beyond the liner 28 but may be substantially wholly within it, and no slits are needed. FIG. 5 shown the production sequence of this embodiment. A gussetted liner 28 is formed from four sheets of polyolefin sheet material using gussetting apparatus known per se. Pre-cut baffles are inserted at a suitable point and welded at weld lines 34 to the liner (stage 1). The edges 33 of the liner 28 are then welded (stage 2). Finally, if desired, fill and discharge spouts 36 and 38 can be shaped, welded and cut out (stage 3). The baffles are not the directly attached to the FIBC but their presence within the liner achieves the object of the invention. FIG. 7 schematically illustrates the finished liner opened out, and FIG. 8 illustrates how it fills with particulate matter.

Figure 9:
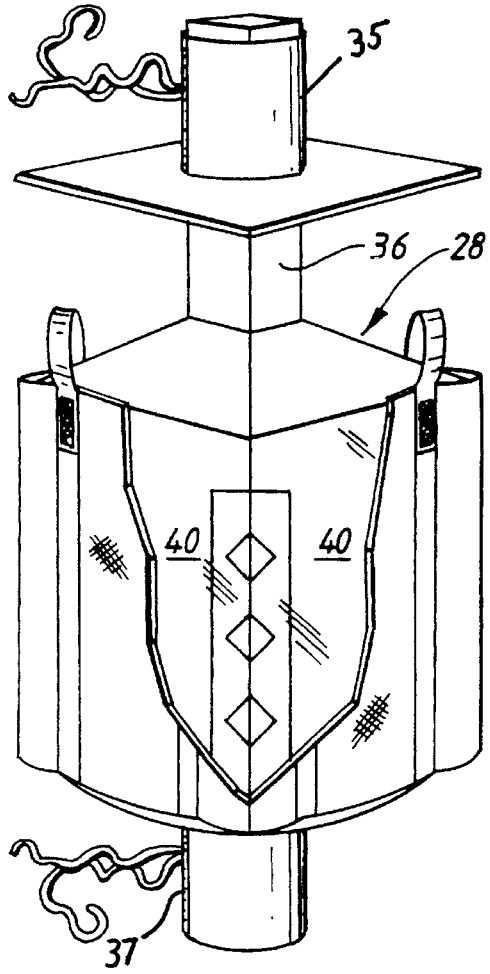
FIG. 9 shows a finished FIBC, partly cut away.

FIG. 9 shows the liner 28 within a finished FIBC. As illustrated, it is affixed to the inside of the FIBC walls in the areas 40 by gluing as an alternative to attaching the liner to the FIBC at the top thereof.

Figure 6:
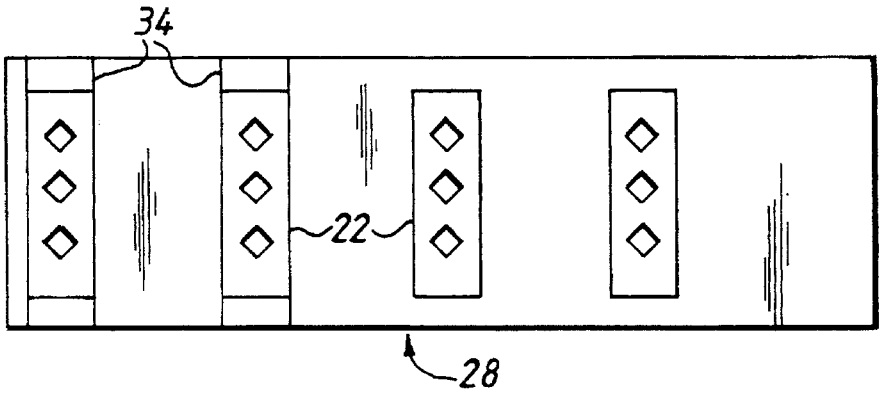
FIG. 6 is a similar view to FIG. 5 shown in an alternative method.

FIG. 6 illustrates an alternative form of liner construction where all four baffles 22 are laid on a sheet of polyolefin and welded thereto at weld seams 34, before folding and gussetting the sheet to form the liner 28. This employs less welds than the method of FIG. 5 but involves some handling problems in forming the gusset shape once the baffles have been welded place. Nevertheless, it may be used if required.

The bag of the invention enables the desirable "square" configuration to be used with sensitive or hygroscopic materials which was not hitherto possible.

I claim:

1. A flexible container bag assembly which comprises: an exterior body including side walls of flexible material having corners to define a square configuration and having lifting loops across the corners, and baffles to maintain the square configuration; and a liner sealed to the baffles, said liner and having an exterior side, the baffles having edges passing through the liner and sealed thereto and said edges positioned at the exterior side of said liner and affixed to the side walls of the exterior body of flexible material across the corners.

2. A container bag assembly as claimed claim 1 further characterized by the edges of the baffles being attached to the exterior body by sewing.

3. A container bag assembly as claimed claim 1 wherein the baffles are affixed to only the liner and the liner is attached to the exterior body.

4. A container bag assembly as claimed in claim 3 further characterized by the liner being attached to the container bag to prevent that the liner from slipping down or folding over before or during filling.

5. A container bag assembly as claimed in claim 4 further characterized by the liner being attached to the container bag at the top thereof.

6. A container bag assembly as claimed in claim 4 further characterized by the liner being attached to the container bag by adhering it to the side walls thereof.

7. A container bag assembly as claimed in any of claim 6 further characterized by the liner being impervious to air and moisture.

8. A container bag assembly as claimed in claim 7 in which the bag is made from a fabric, the fabric from which the bag is formed is woven from one of polyethylene and polypropylene tape yarns.

9. A container bag assembly as claimed in claim 8 further characterized by a lifting loop being spaced across a respective corner of the exterior body of the container bag assembly.

10. A container bag assembly as claimed in claim 9 in which the baffles comprise lengths of extruded fabric having diamond shaped cut-outs to facilitate particulate material passing therethrough.

11. A container bag assembly as claimed in claim 10 in which the baffles are spaced from the top and the bottom of the respective corners of the bag are lesser in length than the height of the liner.

12. A container bag assembly as claimed in any of claim 1 further characterized by the liner being attached to the container bag to prevent the liner from slipping down or folding over before or during filling.

13. A container bag assembly as claimed in claim 12 further characterized by the liner being attached to the container bag at the top thereof.

14. A container bag assembly as claimed in claim 12 further characterized by the liner being attached to the container bag by adhering it to the side walls thereof.

15. A container bag assembly as claimed in any of claim 14 further characterized by the liner being impervious to air and moisture.

16. A container bag assembly as claimed in claim 15 in which the fabric from which the bag is formed is woven from one of polyethylene and polypropylene tape yarns.

17. A container bag assembly as claimed in claim 16 in which the baffles comprise lengths of extruded fabric having diamond shaped cut-outs to facilitate particulate material passing therethrough.

18. A container bag assembly as claimed in claim 17 in which the baffles are spaced from the top and the bottom of the respective corners of the bag and are lesser in length than the height of the liner.

19. A container bag assembly as claimed claim 1 in which the baffles comprise lengths extruded fabric having diamond shaped cut-outs to facilitate particulate material passing therethrough.

20. A container bag assembly as claimed in claim 19 in which the baffles are spaced from the top and the bottom of the respective corners of the bag and are lesser in length than the height of the liner.

21. A container as claimed in claim 1 in which the baffles pass through slits in the liner such that only their edges protrude form the exterior thereof, the liner and baffles being sealed such that the slits are sealed to the baffles by an air-tight and water-tight seam.

* * * * *